US009046260B2

(12) United States Patent
Dial

(10) Patent No.: US 9,046,260 B2
(45) Date of Patent: Jun. 2, 2015

(54) LIGHTED WAND WITH INTEGRATED ELECTRONICS

(71) Applicant: Kent Dial, Dallas, TX (US)

(72) Inventor: Kent Dial, Dallas, TX (US)

( * ) Notice: Subject to any disclaimer, the term of this patent is extended or adjusted under 35 U.S.C. 154(b) by 0 days.

(21) Appl. No.: 13/830,902

(22) Filed: Mar. 14, 2013

(65) Prior Publication Data

US 2013/0250545 A1 Sep. 26, 2013

Related U.S. Application Data

(60) Provisional application No. 61/610,973, filed on Mar. 14, 2012.

(51) Int. Cl.

| | |
|---|---|
| ***F21L 4/00*** | (2006.01) |
| ***A45B 3/00*** | (2006.01) |
| ***A45B 3/04*** | (2006.01) |
| ***F21V 33/00*** | (2006.01) |
| ***F21V 23/04*** | (2006.01) |
| *F21V 17/12* | (2006.01) |
| *F21W 111/10* | (2006.01) |
| *F21Y 101/02* | (2006.01) |
| *F21Y 113/00* | (2006.01) |

(52) U.S. Cl.

CPC . *F21V 33/00* (2013.01); *F21L 4/00* (2013.01); *F21V 23/0442* (2013.01); *F21V 23/0464* (2013.01); *F21V 23/0471* (2013.01); *F21V 17/12* (2013.01); *F21W 2111/10* (2013.01); *F21Y 2101/02* (2013.01); *F21Y 2113/007* (2013.01)

(58) Field of Classification Search

USPC ..... 362/102, 109–120, 183, 217.01–217.17

See application file for complete search history.

(56) References Cited

U.S. PATENT DOCUMENTS

| | | | | |
|---|---|---|---|---|
| 4,722,035 | A * | 1/1988 | Rapisarda | 362/109 |
| 5,471,016 | A * | 11/1995 | Krainer et al. | 361/760 |
| 5,831,834 | A * | 11/1998 | Landolf | 361/782 |
| 6,179,431 | B1 * | 1/2001 | Chien | 362/84 |
| 6,244,723 | B1 | 6/2001 | Talamo | |
| 8,456,329 | B1 * | 6/2013 | Tran et al. | 362/186 |
| 2009/0261737 | A1 * | 10/2009 | Wright et al. | 362/234 |

* cited by examiner

*Primary Examiner* — Mariceli Santiago

(74) *Attorney, Agent, or Firm* — John Lindsay

(57) ABSTRACT

A wand for visual communication comprising an elongated handle having an interior region, an elongated optical element having an interior region composed of light transparent material configured for joinder to the handle, and lighting disposed in the interior region and in communication with a control circuit. The control circuit comprises a controller configured to energize said lighting in response to user input and sensor input.

2 Claims, 6 Drawing Sheets

LIGHTED WAND WITH INTEGRATED ELECTRONICS

PRIORITY

The present invention claims priority to provisional application 61/610,973, which has a filing date of Mar. 14, 2012, which is hereby incorporated by reference.

BACKGROUND

1. Field of the Invention

The present invention relates to a wand for use in signaling, more specifically to a wand with integrated electronics for use in visual signaling.

2. Description of the Related Art

In various safety or communications settings during the night, lighted wands are used to guide or signal other persons. Common uses of wands include directing traffic in the case of an automobile accident, pedestrian situations such as a forest hike, or directing airplanes at an airport.

At an airport, the aircraft ground handling staff service the aircraft while it is on the ground, direct aircraft into and out of gates, and load or unload cargo from the aircraft. Speed, efficiency, accuracy, and safety are important in ground handling services in order to minimize the time during which the aircraft must remain parked at the gate. Because of this, the individual ground handling staff often perform multiple functions, making devices that are readily available for use when transitioning between tasks more convenient.

A function of the high importance is the process of directing aircraft into and out of the gates. During air marshalling, the aircraft ground handlers visually signal pilots and/or other ground personnel using a combination of hand gestures, arm gestures, and lighting. At the airport, the aircraft marshaller may signal the pilot to turn, keep turning, move forward, slow down, stop, shut down engines, or other signals while directing the aircraft to the gate or runway.

Sometimes, the aircraft ground handlers keep a pair of marshalling wands at their waist throughout their shift, meaning that the wands are subject to frequent impact, prematurely shortening their lifespan. The alternative is to the leave the marshalling wands at a fixed location and then retrieving them as needed. However, this can cause delays in ability to marshal the aircraft. The knowledge of state of the available power in the wand is also more at risk when the wands are not controlled by a single person.

The marshalling wands are often shared among handlers, with no single handler being responsible for maintaining the device, thus the battery life is important. Moreover, the marshalling wands are subjected to harsh treatment, which shortens their useful life.

For the above reasons, it would be advantageous to provide a wand with integrated electronics which enables readily access, consumes minimal power, and withstands common impacts within the environment.

SUMMARY

The present invention is directed to a lighted wand with integrated electronics with a preferred use for visual communication with aircraft. A wand for visual communication comprising an elongated handle having an interior region, an elongated optical element having an interior region composed of light transparent material configured for joinder to the handle, and lighting disposed in the interior region and in communication with a control circuit. The control circuit comprises a controller configured to energize said lighting in response to user input and sensor input.

These and other features, aspects, and advantages of the invention will become better understood with reference to the following description, and accompanying drawings.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for claims and as a representative basis for teaching one skilled in the art to employ the present invention in virtually any appropriately detailed system, structure or manner.

Figure 1:
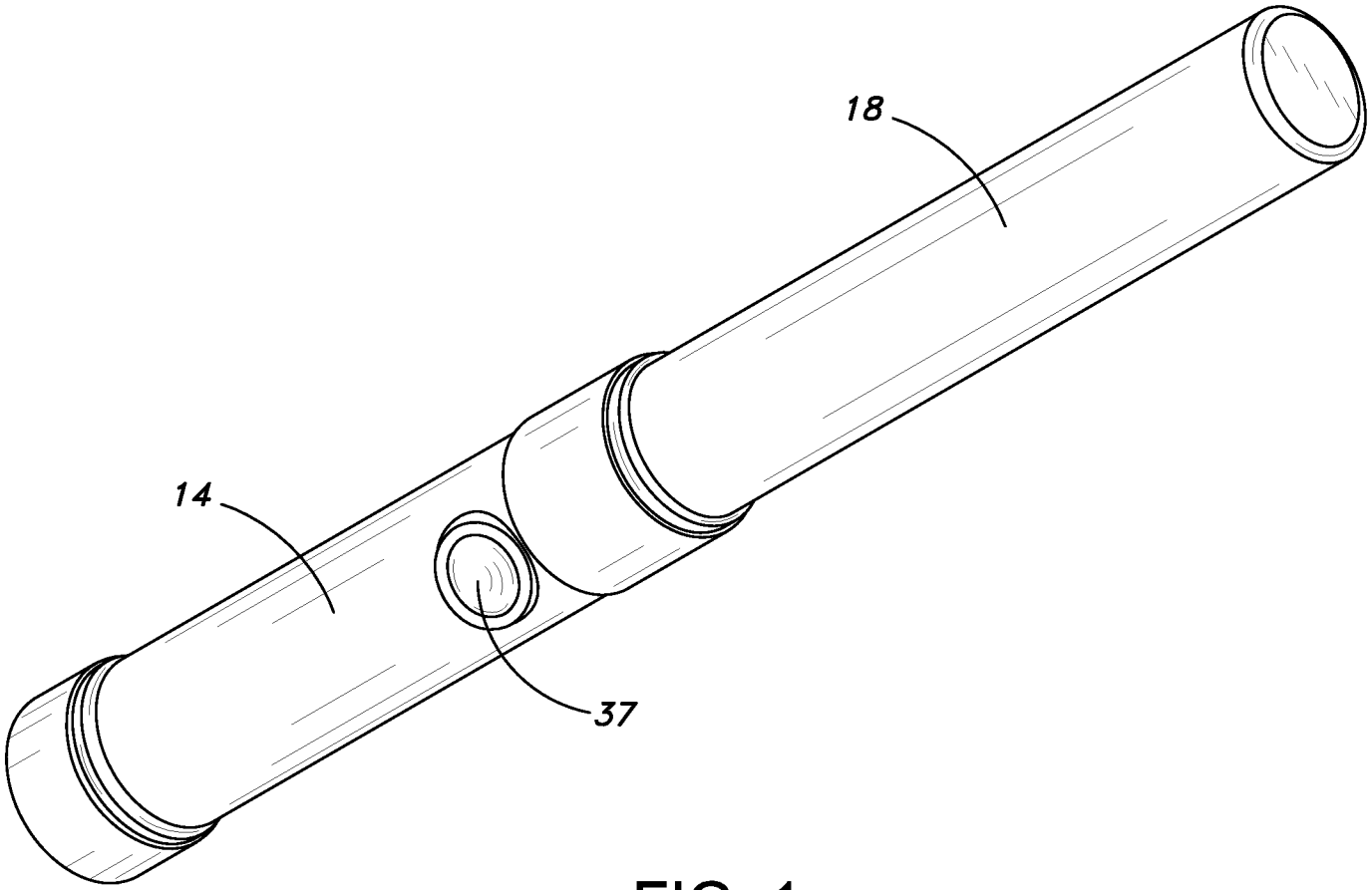
FIG. 1 shows a side perspective view of a wand according to the current invention.
Figure 2:
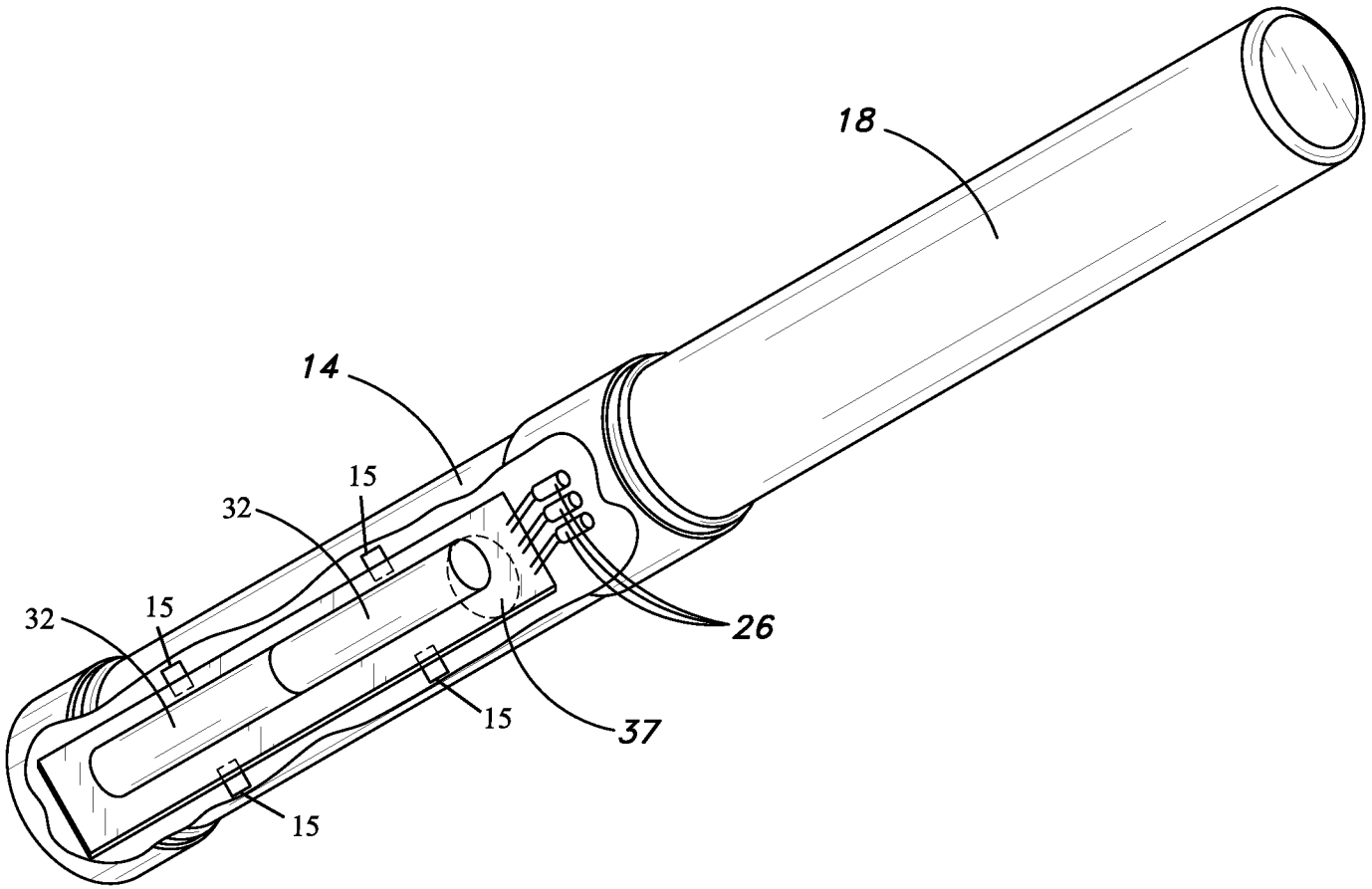
FIG. 2 shows a side perspective partial transparent view of the embodiment of FIG. 1.

The present invention relates to a lighted wand with integrated electronics for exemplary use in visual communication with aircraft. Referring to FIG. 1, a side perspective view of an embodiment of the integrated air marshalling wand 10 is depicted. The embodiment includes a wand 12, which is further comprised of a handle 14, a control circuit 30, lighting 26, and an optical element 18.

Lighted wand 10 includes an elongated handle 14 presenting a hollow interior and an exterior surface. Handle 14 is formed of a resilient material such as molded plastic or rubber or the like to support and impact, durability, and protection of internal components of lighted wand 10. The handle 14 can be configured with various cross-sectional profiles. In a first configuration, the handle 14 has a circular cross-section. In a second configuration, the handle has a rounded triangular cross-section. That is to say that it has curvilinear vertices versus sharp, angular vertices. The exterior surface of the handle 14 optionally includes a plurality of ridges to improve the hand gripping characteristics. A switch 33 may be disposed upon the exterior of handle 14 in a manner indicated below in greater detail. The interior surface of the handle 14 includes mounts 15, depicted as tabs for slidable placement of the circuit board of the control circuit 30.

Handle 14 includes structure for attachment of its distal end to the proximal end of the optical element 18. Such structures include sizing the handle 14 end and the optical element's 18 end for secure, slidable attachment. Other suitable means for attachment such as chemical coatings or ridges may be employed. The illustrated structures include a cooperative threaded pair, with threading on the exterior of the handle 14 for cooperative attachment to the threaded interior of the optical element 18. An optional seal is interposed between the handle and the optical element 18.

The optical element 18 is composed of a length of optically transparent material suitable to allow light to pass therethrough while protecting the internal components of the device 10. The optical element 18 is a preferably conically shaped, although it may take other shapes.

The lighted wand 10 includes lighting 26. The lighting 26 employed should be durable, impact resistant, energy-efficient, long-lasting, and luminous. In a first embodiment, the lighting 26 is point lighting such as LEDs, microLEDs, LED arrays, or the like. The lighting can be single or multi-color, such as an RGB LED. In the current embodiment, the lighting 26 is disposed proximate the distal end of the handle 14 and the proximal end of the optical element 18.

In a second embodiment, the lighting 26 is also point lighting such as LEDs, microLEDs, LED arrays, or the like. In this embodiment, the light 26 is disposed proximate the distal end of the handle 14 and the proximal end of the optical element 18. A frustoconical optical element 18 defines an interior cavity and in accordance with the present invention defines a plurality of cylindrical lens elements generally equally spaced about the interior of the optical element 18. Thus, as mentioned above, optical element 18 is formed of an optically transparent material such as clear or tinted transparent material utilizing molded plastic or the like, which allows each of lens elements to refract light impinging the element surfaces to provide a non-uniform optical light outwardly through optical element. As a result, the light output of optical element is preferably formed into radially extending higher intensity focused portions. Additional disclosure in connection with this embodiment is contained in U.S. Pat. No. 6,244,723 to Talamo, which is hereby incorporated by reference.

In a third embodiment, the employed lighting 26 is incorporated in the optical element 18. The lighting 26 may be placed in the proximal or distal regions of the cavity of the optical element 18, on the interior surface of the optical element 18, the exterior surface of the optical element 18, or inline with the surface of the optical element 18. Representative lighting 26 includes, but is not limited to, electroluminescent wire, light pipes, LEDs, microLEDs, LED arrays, and the like. The preferred configuration of this embodiment employs light pipes on the interior surface of the optical element 18.

Figure 3:
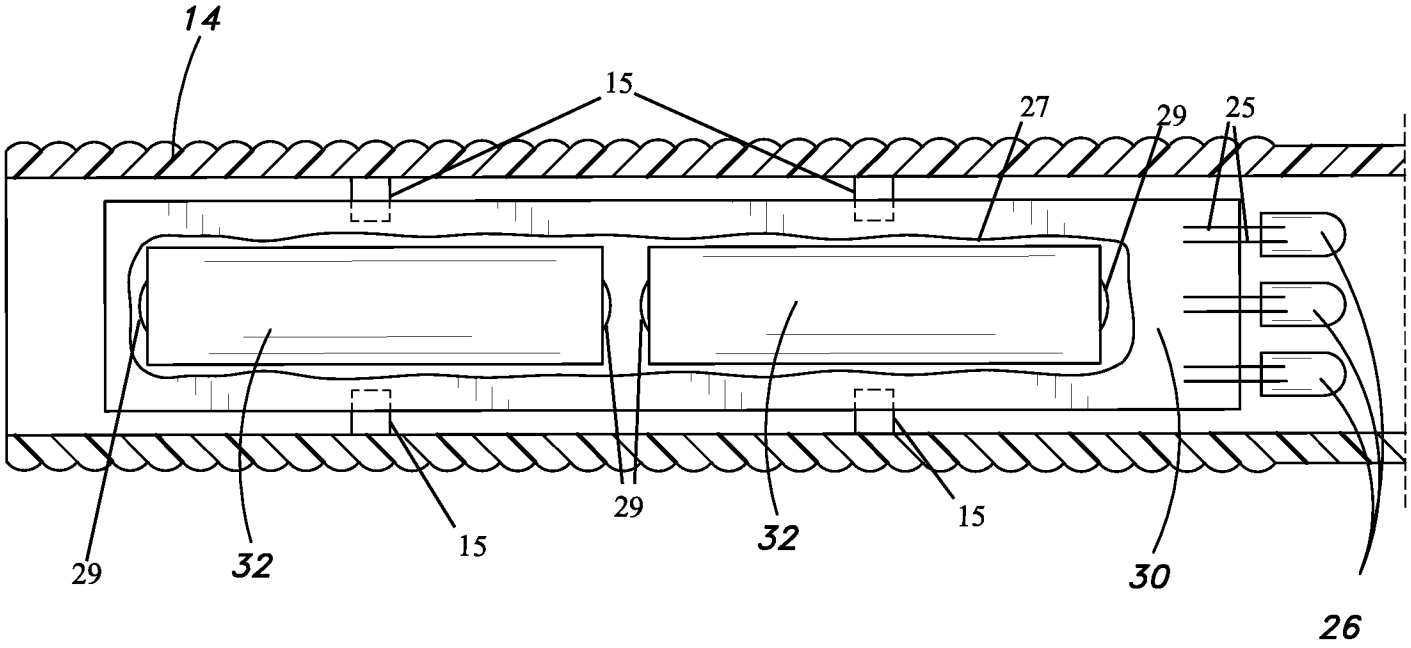
FIG. 3 shows a side perspective transparent view of the embodiment of FIG. 1.
Figure 4:
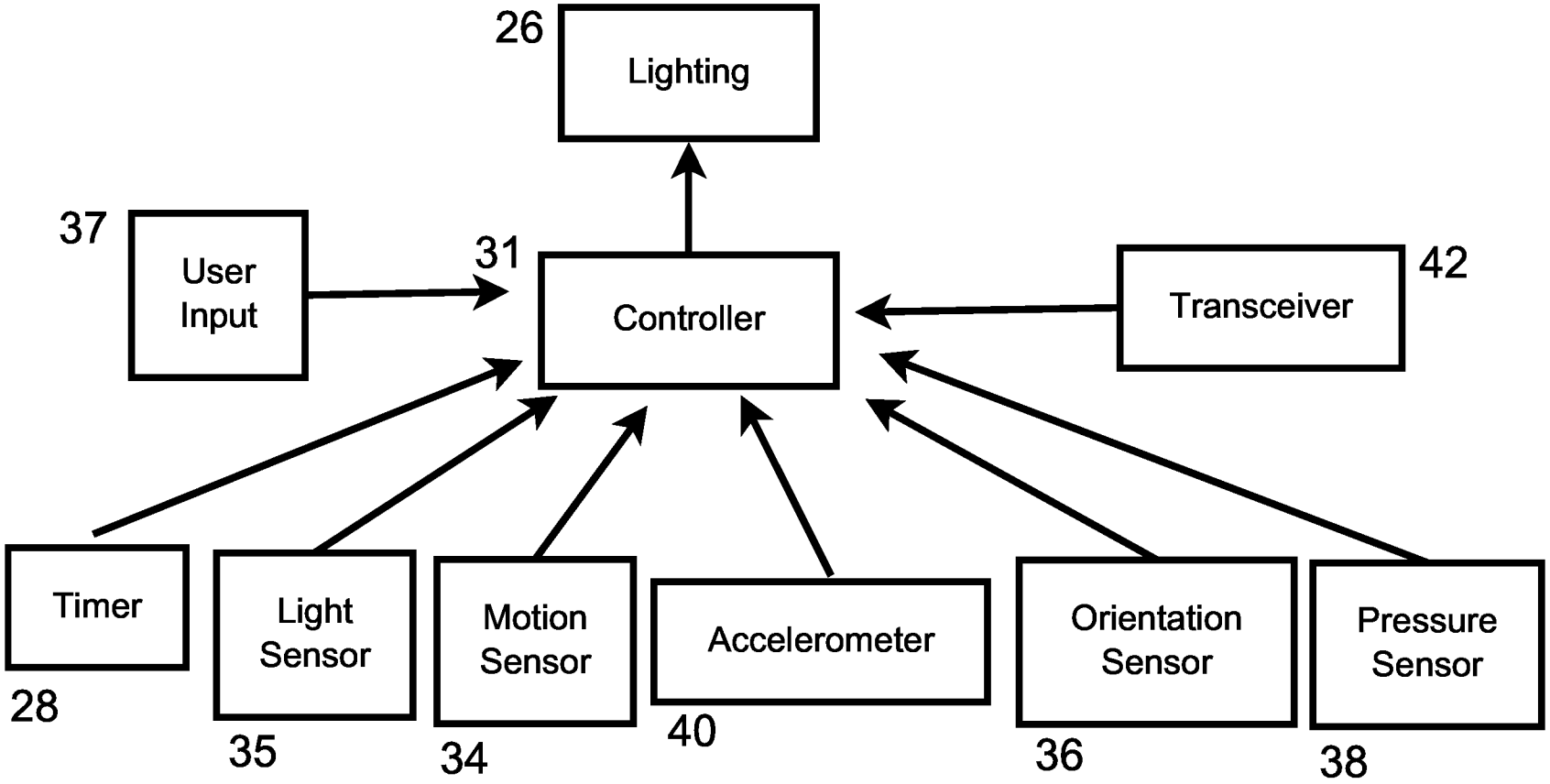
FIG. 4 illustrates a block diagram of the embodiment of FIG. 1.
Figure 5A:
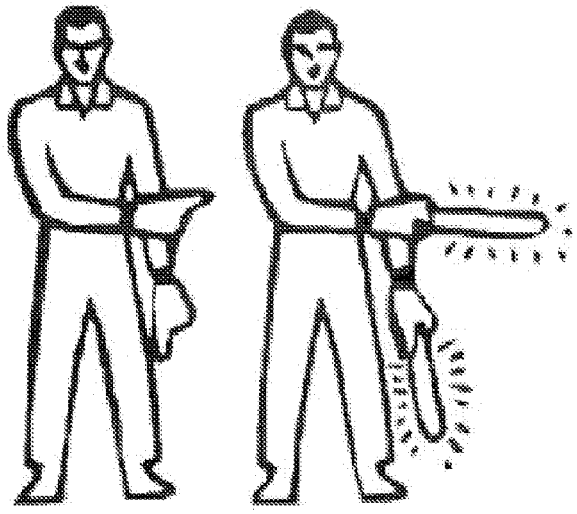
FIGS. 5*a-c* illustrates a subset of aircraft marshalling signals of one system.
Figure 5B:
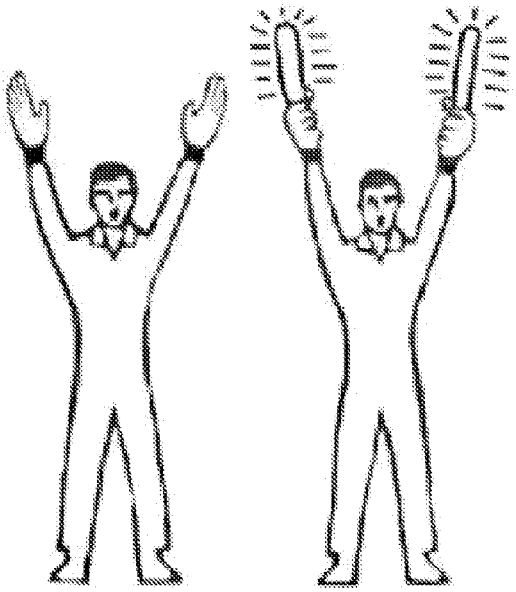
Figure 5C:
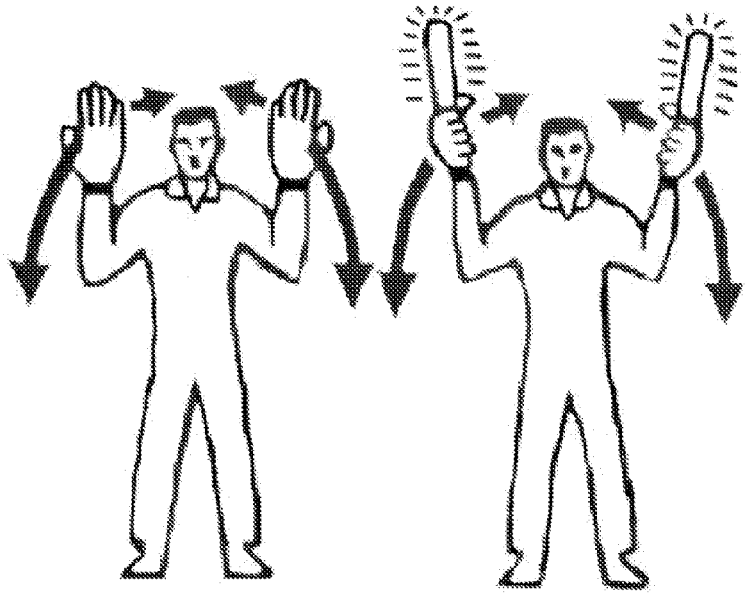
Figure 6:
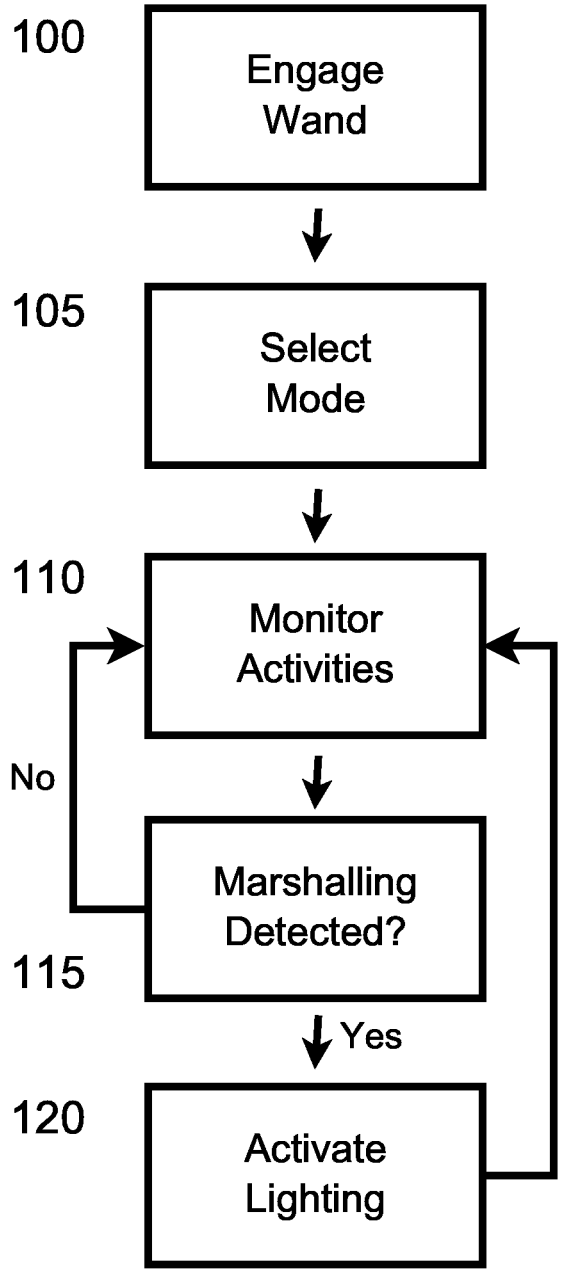
FIG. 6 illustrates a flowchart of a process implemented to the embodiment of FIG. 1.

Referring to FIG. 3, a transparent view of an embodiment of the current invention is depicted. The lighting 26 is in electrical communication with a control circuit 30, which selectively powers the lighting 26 in response to input from the user and other control circuit 30 elements. A controller 31 is included in the circuit to control the lighting 26. It is operable to receive and process input, determine whether power should be provided to the lighting 26, and then direct power to the lighting 26 when conditions dictate. Key factors in selecting a controller 31 for deployment in this invention include clock speed, power consumption, and availability of functions such as analog to digital conversion or comparators. The majority of the control circuit 30, and specifically the controller 31, is located in the combined interior region of handle 14 and optical element 18, preferably in the mounts 15 of the handle 14.

The control circuit 30 is operable to detect current usage of the integrated air marshalling wand 10 in response to sensor input and user input. The control circuit 30 receives and processes the input, selectively controlling when the lighting 26 is energized. The integrated air marshalling wand 10 optionally includes at least one sensor 28 34 35 36 38 40 in order to facilitate determination of hand movements, hand position, hand orientation, wand 10 contact with other surfaces, and other conditions. The controller 31 processes the combined sensor input and user input to determine whether the integrated air marshalling wand 10 is currently being used for air marshalling or should be in an inactive state.

Referring to FIG. 9, the control circuit 30 depicts a power supply 32, lighting 26, a controller 31, user input 37, a timer 28, a motion sensor 34, a light sensor 35, orientation sensor 36, a pressure sensor 38, an accelerometer 40, and a transceiver 42. The power supply 32 of FIG. 3 includes a pair of rechargeable batteries connected in parallel to the control circuit 30 via the soldered contacts 29. The depicted batteries are chemically secured 27 to the control circuit 30 with silicone or other suitable compositions in the art.

In an exemplary configuration, the leads 25 of the lighting 26 are secured directly to the control circuit 30 at one of its ends. In this configuration, the control circuit 30, power supply 32, and lighting 26 form a unitary portion of the device 10 operable for slidable placement into the tabs 15 of the handle 14. Optionally, the device includes a sealant (not pictured) such as silicone, epoxies, or others known in the art to coat the control circuit 30, power supply 32, leads 25 to the lighting 26, and select sensors, leaving access for recharging.

The user input 37 can simply be a button 33. Depressing the button 33 can indicate an on/off state or toggle the mode of the control circuit 30. For example, a single push may signal to the controller 31 that the lighting 26 should unconditionally be activated. A second push may signal to the controller 31 that the lighting 26 should conditionally be activated based on sensor input. A third push may signal to the controller 31 that the lighting 26 should conditionally be activated based on sensor input for the interval held in the timer 28. A fourth push may signal to the controller 31 that the lighting 26 should unconditionally be deactivated.

The light sensor 35 can be a photovoltaic, photoresistor, or other similar device which varies current according to the ambient light intensity. The controller 31 processes the light sensor 35 input to determine a day or night condition.

The motion sensor 34 is a device which detects motion and optionally relays velocity and relative direction in the x, y, and z axis of the motion. The controller 31 processes the motion sensor 34 input to determine if motion is occurring and the direction of that motion.

The orientation sensor 36 is a device which detects the angular position of the wand 10. The controller 31 processes the orientation sensor 36 input to aid determination of placement and current usage of the wand 10.

The pressure sensor 38 is a device embedded in the handle 14, preferably in the bottom section 21, where the user grips the device 10. The controller 31 processes the pressure sensor 38 input to aid current usage of the wand 10.

The accelerometer 40 is a device which measures acceleration forces. The controller 31 processes the accelerometer 40 input to aid determination of the current usage of the wand 12.

Transceiver 40 is a device which transmits and receives radio frequency signals. In the present embodiment, the transceiver 40 can transmit and receive sensor data to/from a second integrated air marshalling wand 10 to augment information available to any controller 31.

The integrated air marshalling wand 10 functions to detect its current usage by using the sensor input to determine the real-time and recent hand motion, hand placement, and hand orientation data. It then compares that information with the expected hand motion, hand placement, and hand orientation data in aircraft marshalling.

FIGS. 10*a-c* show a subset of motions in one aircraft marshalling system. It should be understood that is just one system among others and that the aircraft marshalling systems commonly incorporate different hand and arm positions, as well as possible lighting 26 colors. FIG. 10*a* shows an aircraft marshal with one integrated air marshalling wand 10 on his right hand statically positioned in a horizontal orientation. A second integrated air marshalling wand 10 in his left hand is statically positioned in a vertical orientation lower than the first integrated air marshalling wand 10. This signal indicates to proceed to the next aircraft marshal. Where the control circuit detects this user's position, it activates the lighting 26.

FIG. 10*b* shows an aircraft marshal with a pair of integrated air marshalling wands 10, where each is oriented with the bottom section 21 facing forward, held above head height, and vertically oriented. This signal indicates that this is the correct aircraft marshal. Where the control circuit detects this user's position, it activates the lighting 26.

FIG. 10*c* shows an aircraft marshal wearing an integrated air marshalling wand 10 on each hand and at about shoulder height. Each is oriented with the bottom section 21 facing rearward and vertically oriented. Each integrated air marshalling wand 10 is repeatedly moved upward and backward. This signal indicates that the aircraft should move forward. Where the control circuit detects this user's position, it activates the lighting 26.

A logic table based on the inputs is implemented to the controller 31 for a complete aircraft marshalling signal set. A representative subset of the instruction set is displayed below:

| User Input | Light Sensor | Pressure Sensor | Orientation Sensor | Accelerometer | Activate Light? |
|---|---|---|---|---|---|
| Off | low light | no pressure | vertical | repeated changing motion | false |
| On | low light | pressure | vertical | repeated changing motion | false |
| On | low light | no pressure | horizontal | repeated upward motion | false |
| On | low light | no pressure | vertical | repeated upward motion | true |

Optionally, the integrated air marshalling wand 10 utilizes power management features. First, as mentioned, the control circuit 30 can incorporate a timer 28 to automatically power down the integrated air marshalling wand 10. User input 33 in activating the wand 10 can signal to the controller 31 that the lighting 26 should be activated based for the interval stored in the timer 28. The interval is configurable and can be optimized for the environment. Upon the interval passing the timer 28 signals the controller 31. The controller 31 may immediately power down the control circuit 30 or may check for user activity. If user activity is detected, the controller 31 may store the instruction in its queue for processing after user activity ceases. Secondly, the device can incorporate integrated chips with sleep states or low power states, such as the illustrated PIC18F13K22 controller 31, which can be toggled to lower power states by such means as altering the clock rate. Thirdly, the control circuit 30 may alter operation according to the battery power. When the battery is at or near full capacity, the controller 31 may provide the normal current to the lighting 26. When the battery at lower capacity, the controller 31 may direct less current to the lighting 26 and signals the user. Additionally, the control circuit 30 may use sensor input to alter power consumption. For example, the controller 31 may receive sensor input for a period of time where a series of input signals from the motion sensor 34 indicate that no motion has occurred. Alternatively, a series of relative high pressure signals from the pressure sensor 38 may indicate that the user is not engaged in air marshalling activity. In either case, the controller 31 may enter a low power or sleep state.

With the logic and power control implemented to the integrated air marshalling wands 10, it is ready for use. Referring to FIG. 11, the aircraft marshal engages the integrated air marshalling wands 10 by gripping them 100. The aircraft marshal presses the button to signal to the controller 31 that the lighting 26 should conditionally be activated based on sensor input 105 and goes about ground control activity. The integrated air marshalling wands 10 monitor the aircraft marshal's actions 110 for aircraft marshalling activity 115. If no aircraft marshalling activity is detected, the monitoring of the marshal's actions continues. If aircraft marshalling activity 115 is detected, the lighting is activated 120. The integrated air marshalling wands 10 monitor the aircraft marshal's actions 110 for continued aircraft marshalling activity 115.

Insofar as the description above and the accompanying drawing disclose any additional subject matter that is not within the scope of the single claim below, the inventions are not dedicated to the public and the right to file one or more applications to claim such additional inventions is reserved.

What is claimed is:

1. A wand for visual communication comprising:

an elongated handle;

an elongated optical element having an interior region composed of light transparent material configured for joinder to said handle;

a battery chemically joined to a control circuit;

lighting disposed in the interior region and in communication with said control circuit;

a sealant operable to coat the control circuit, a power supply, and a portion of the lighting; and said control circuit comprising a controller configured to energize said lighting in response to user input and sensor input.

2. A control circuit for insertion into the interior region of a wand for visual communication, said control circuit comprising:

a battery chemically joined to a circuit board of said control circuit;

lighting integrally joined proximate an end of a circuit board of a said control circuit, said lighting in communication with said control circuit;

a sealant operable to coat said control circuit, a power supply, and a portion of the lighting; and said control circuit comprising a controller configured to energize said lighting in response to user input and sensor input.

* * * * *